United States Patent [19]

Da Costa

[11] Patent Number: 5,012,896

[45] Date of Patent: May 7, 1991

[54] LUBRICATING SYSTEM FOR ROTARY HORIZONTAL CRANKSHAFT HERMETIC COMPRESSOR

[75] Inventor: Caio Mario F. N. Da Costa, Joinville, Brazil

[73] Assignee: Empresa Brasileira de Compressores, Joinville, Brazil

[21] Appl. No.: 475,358

[22] Filed: Feb. 2, 1990

[30] Foreign Application Priority Data

Feb. 17, 1989 [BR] Brazil ..... PI8900780

[51] Int. Cl.[5] ..... F01M 1/00

[52] U.S. Cl. ..... 184/6.16; 418/96; 418/98

[58] Field of Search ..... 184/6.16, 6.17, 31; 417/410, 369; 418/63, 96, 98, 99

[56] References Cited

U.S. PATENT DOCUMENTS

| | | | |
|---|---|---|---|
| 4,449,895 | 5/1984 | Kurahayashi | 184/6.16 |
| 4,472,121 | 9/1984 | Tanaka et al. | 184/6.16 |
| 4,568,253 | 2/1986 | Wood | 184/6.16 |
| 4,624,630 | 11/1986 | Hirahara et al. | 418/63 |
| 4,781,542 | 11/1988 | Ozu et al. | 184/6.16 |

*Primary Examiner*—Ira S. Lazarus
*Assistant Examiner*—Alan B. Cariaso
*Attorney, Agent, or Firm*—Darby & Darby

[57] ABSTRACT

A lubricating system for a rotary horizontal crankshaft hermetic compressor, including a hermetic shell housing a cylinder block, main bearing and sub bearing which supports one end portion of a crankshaft and an electric motor which supports the other end portion. The shell defines as a lubricating oil sump and receives gas from the cylinder through a discharge orifice. The cylinder block divides the shell into a rear section, housing the electric motor, which section has the outlet end of the gas discharge orifice, and a front section which is in communication with the end of the compressor discharge tube and with the rear shell section through a lower oil passage in the sump. There is a gas duct and a level regulating passage with the gas duct being dimensioned to create a pressure differential between the two sections which is sufficient to elevate the lubricating oil in the front section up to the crankshaft end for lubricating it.

8 Claims, 2 Drawing Sheets

LUBRICATING SYSTEM FOR ROTARY HORIZONTAL CRANKSHAFT HERMETIC COMPRESSOR

BACKGROUND OF THE INVENTION

The present invention relates to a lubricating system for a horizontal compressor, and more specifically to a pressure differential lubricating system for a rotary rolling piston and horizontal crankshaft hermetic compressor, which are usually used in small refrigerating systems.

Horizontal compressors of the rotary rolling piston type have been more and more used in refrigerating appliances because they make possible, comparing with the vertical model, an additional gain in terms of useful volume for the refrigerator.

The oil circulation in horizontal crankshaft compressors cannot occur, according to the technique normally used in vertical crankshaft compressors. This technique includes providing a centrifugal pump at the shaft lower extremity which is immersed in the sump reservoir placed at the bottom of the shell with the pump pushing the oil through the shaft up to the parts which require lubrication. For lubrication of horizontal crankshaft compressors, it is necessary to provide means to cause the oil to rise from its sump up to the shaft, where it is distributed through the bearings and other parts to be lubricated.

One of the known ways for oil elevation and circulation is disclosed in U.S. Pat. No. 4,449,895. That patent describes a rotary horizontal crankshaft hermetic compressor whose lubricating system comprises a curved tube which is extended up to the oil sump placed at the bottom of the shell, and a helical spring which rotates in its interior. The spring has one of its ends connected to the eccentric rotating piston shaft while its other end remains immersed in oil.

When the eccentric shaft is driven, it transmits rotation to the spring, causing the oil to be elevated through the annular passage created between the spring coils and the tube internal surface. The oil is, in such case, is conducted up to the pressure chamber placed at the sub bearing extremity, being then distributed along it as well as the eccentric shaft and main bearing by means of grooves made on the shaft surface.

In spite of assuring a continuous supply of oil for the bearings and eccentric shaft, the spring arrangement has the inconvenience of causing additional mechanical losses in the compressor due to the energy dissipation which occurs by friction between the spring coils and the tube internal surface.

Another inconvenience of this approach is that the shell must necessarily have a longer length due to the necessity of larger internal space for the assembly of the oil tube at the sub bearing extremity. This length increase, besides requiring a greater quantity of material (steel plate) for the shell conformation, results in a greater suction gas superheating with consequent drop of compressor volumetric efficiency. The superheating occurs due to the heat flux of compressed gas discharged in the interior of the shell at high temperature for the suction gas, which is admitted to the system through a connecting tube internal to the shell. The longer the tube length, the greater is the heat flux through it and, consequently, the suction gas superheating.

Another disadvantage of the previous technique concerns the cost of the spring manufacture, which tends to be raised due to the non-circular transversal section of the wire that requires a specifically made spring from the manufacturer.

Another known way for elevating and circulating oil is disclosed in U.S. Pat. No. 4,472,121. This patent describes a rotary horizontal type compressor provided with a lubricating system in which the lubricating oil accumulated at the bottom of the shell is supplied through a lubricating hole made in a central and axial way on the eccentric shaft by the effective use of refrigerant gas pulsation at high pressure discharged from the compression chamber. Therefore, the compressor is provided with: a lubricating oil feeding tube having one end in communication with the lubricating hole of the eccentric shaft and the other end open to the lubricating oil in the sump. There is also a refrigerant gas discharge tube, having one end inserted at the end of the lubricating oil feeding tube open to the sump, and the other end in communication with the refrigerant gas discharged from the compressor chamber.

When the refrigerant gas is discharged from the discharge tube inward the end of the oil feeding tube, the one open to the sump, the lubricating oil accumulated at the bottom of the shell and mixed with the refrigerant gas is carried inward along the lubricating oil feeding tube through a passage formed at the connection of the ends of the two tubes being then supplied in an oil collector and distributed through the central lubricating hole in the parts to be lubricated. Despite its simple construction and low cost, this system presents the inconvenience of causing oil foaming due to the refrigerant absorption, reducing the viscosity of the lubricant and altering, consequently, the bearings lubricating conditions.

U.S. Pat. No. 4,568,253 discloses an oil pump for a rotary horizontal crankshaft hermetic compressor whose bearing is provided with a channel vertically arranged in communication with the oil sump. The eccentric shaft has a portion of reduced diameter which forms with the bearing an annular chamber. Several helical grooves are provided arranged in an angularly opposite way and in communication with the annular chamber.

The eccentric shaft rotation develops a low pressure zone at the annular chamber causing the lubricant to be suctioned upward through the bearing channel and the annular chamber alignment. The helical grooves distribute the annular chamber lubricant to the end portions opposite to the eccentric shaft, lubricating the bearings and other movable parts of the compressor.

In spite of presenting a simple and low cost construction, this type of pump also presents in practice some inconvenience. The helical grooves made on the shaft end portions reduce the sustaining effective area of the bearing, already reduced by the recessed intermediate portion of the shaft, causing contact and, consequently, the wear of the eccentric shaft and the bearing.

Another problem is that the oil flux in this system is seriously affected by the presence of gas refrigerant in the system, which occurs primarily at the compressor start-up time. This gas refrigerant is released from the oil during the compressor stand-still periods, creating bubbles that are kept at the bearing and oil feeding channel. At the compressor start-up time, the depression created between the shaft and the bearing causes expansion of those bubbles, giving rise to a certain delay in the suction and oil supply at the bearing, thereby reducing its lubrication effect.

Another known way of elevating oil up to the crankshaft is described in U.S. Pat. No. 4,624,630 which is accomplished by using the difference of pressure between the cylinder internal volumes, especially the suction one, and the high pressure inside the shell.

The oil in the sump is forced by the fluid refrigerant which is discharged at high pressure in the interior of the shell, draining the oil through a hole that connects the oil sump to the interior of the cylinder. The hole is usually in the space between the crankshaft eccentric side and the bearing cover wall, and communicates with various lubricating channels. This solution, although extremely simple, has the inconvenience of not giving full lubrication to the channels, even in normal operating conditions. In conditions of small pressure differential the lubrication can be substantially reduced.

OBJECT OF THE INVENTION

It is an object of the present invention to provide a lubricating system for a rotary horizontal crankshaft hermetic compressor operating by pressure differential which is able to remedy the deficiencies mentioned above of the prior systems.

It is also an object of the present invention to provide a lubricating system of the above type which has a low energy consumption and that also supplies a suitable and continuous oil flow to the compressor components without affecting the operation of the compressor.

Another object of the present invention is to provide a lubricating system such as the one mentioned before which occupies small, or no, internal space and is of simple construction, high reliability and low cost without movable parts.

BRIEF DESCRIPTION OF THE INVENTION

The compressor being discussed includes a hermetic shell having suction and discharge tubes. The shell houses a compressor set which includes a cylinder block in whose interior a rolling piston rotates as the eccentric portion of a horizontal shaft having one end portion supported by a sub bearing and main bearing adjacent to the cylinder block. Another end portion of the shaft is fixed to the rotor of an electric motor. The shell defines a lubricating oil sump at its bottom and receives the gas that comes from the cylinder through a discharge orifice.

According to the invention the compressor set divides the interior of the shell into a rear section, housing the electric motor and having the outlet end of the discharge orifice. There is also a front section in communication with the discharge tube. The two sections communicate through an oil passage arranged below the minimum oil level in both sections. There is a gas duct open to the rear shell section at a point above the maximum oil level in this section and to the front section at a point above the oil operational level in this section. An oil level regulating duct or passage is arranged in a way to define the maximum level of oil in the front section. The dimensioning of the gas duct is such that the oil operational level in the front section is raised by the pressure differential between the two sections, until at least the lower half of the front end of the horizontal shaft is covered with oil, this end of the horizontal shaft being provided with a central axial hole in communication with radial access channels to the bearings.

With the above constructive arrangement the compressed gas discharge is initially driven, to the rear section of the shell and then, returned to the front section through the gas passing duct in a way that the final gas discharge outside the shell takes place through the discharge tube in the front section, creating a pressure differential between the two internal sections of the shell. This pressure differential makes possible a difference of levels in the oil sump so that the oil level in the front section will be higher and enough to reach the crankshaft level and, through it, get into the internal lubricating channels.

In order to prevent the oil in the front section from reaching over a certain maximum level, a regulating passage is provided which, in the preferred embodiment, has its outlet to the adjacent rear section in communication with the discharge orifice of the compressor set, in a way to create with it an ejecting effect. This functions to keep the pressure differential effect between the two sections, in the case of gas passage, i.e., in normal operation, or to create the effect of draining the oil from the front section to the rear one since the maximum volume is reached and kept the same.

A lubricating system made as described has the advantage of having an extremely simple construction, no movable parts and provides good lubrication to the crank shaft.

BRIEF DESCRIPTION OF THE DRAWINGS

The invention will be described as follows by making reference to the accompanying drawings, wherein.

DETAILED DESCRIPTION OF THE INVENTION

Figure 1:
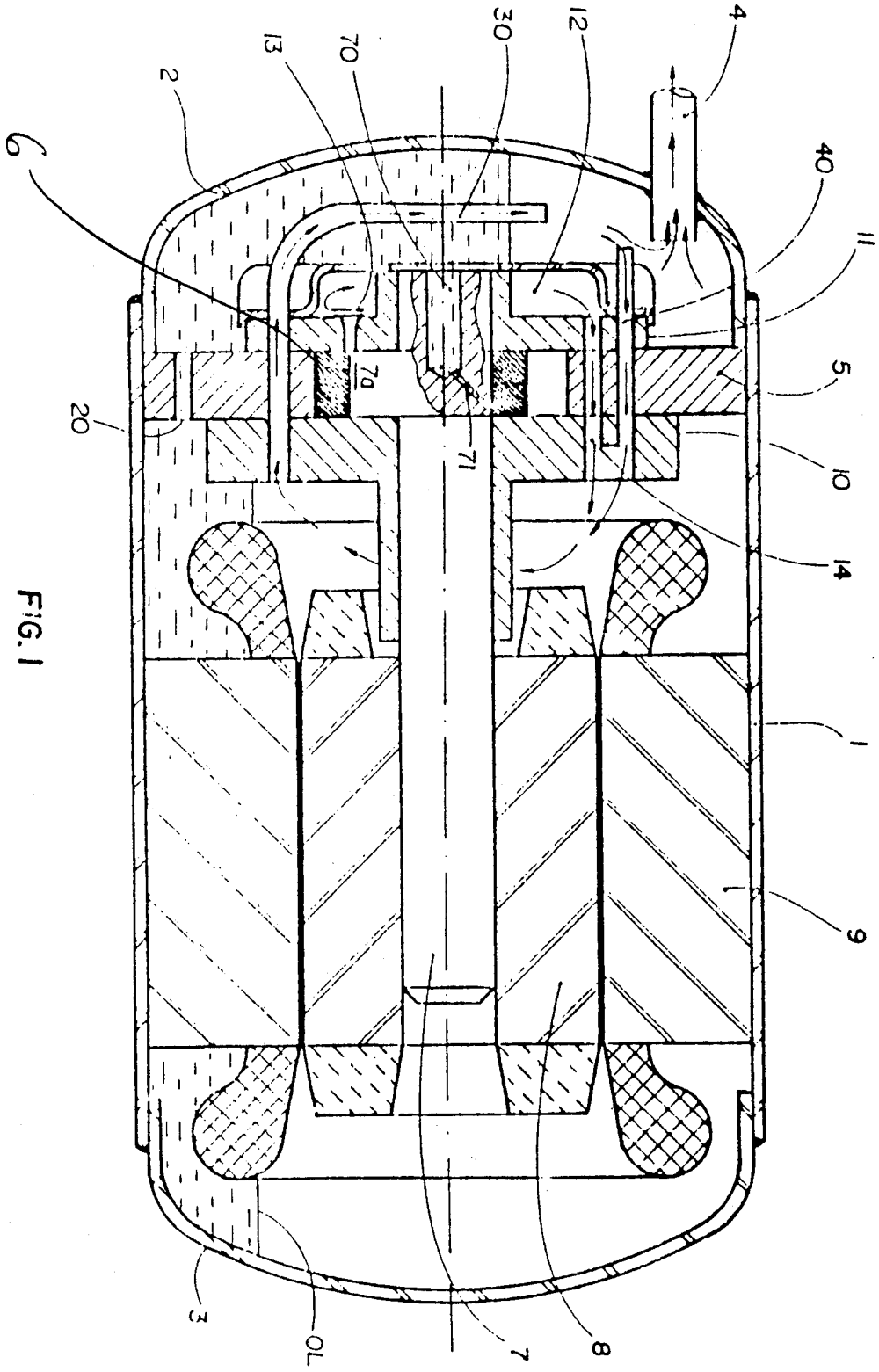
FIG. 1 shows a longitudinal sectional view of a rotary horizontal crankshaft hermetic compressor according to the invention.

The rotary compressor illustrated in FIG. 1 is of the type that includes a hermetic shell 1 with rear 3 and front 2 end covers. The front end cover 2 carries at least a discharge tube and a suction tube (not illustrated).

The hermetic shell 1 houses the compressor set which includes a cylinder block 5 in whose interior a rolling piston 6 rotates as the eccentric portion 7*a* of a shaft 7. The shaft 7 is mounted to the rotor 8 of an electric motor whose stator 9 is fixed inside the hermetic shell.

The horizontal shaft 7 is mounted on a main bearing 10 and a sub bearing 11, both of which are adjacent to the cylinder block 5. The sub bearing 11 end face carries a discharge muffler chamber 12 having a discharge valve 13.

The hermetic shell 1 also defines a lubricating oil sump 50 at its bottom portion as illustrated in FIG. 1.

As can be seen in FIG. 1, the cylinder block 5 fixed inside the hermetic shell 1 effectively divides the shell into a rear section, housing the rotor 8 and the stator 9 of the electric motor and a front section into which the discharge tube 4 is inserted.

The rotary compressor being discussed also includes a discharge orifice 14 extending through the cylinder block 5 and the flanges of the main bearing 10 and sub bearing 11 in a way to provide communication between the interior of the discharge muffler chamber 12 and the internal volume of the rear section of the hermetic shell 1 at a point above the maximum lubricating oil (LO)

level in the interior of the rear section With this arrangement. the gas compressed by the piston-cylinder set is ejected in the discharge muffler chamber 12 and is then conducted back to the rear section of the hermetic shell through the said discharge orifice 14 thereby pressurizing the interior of the said rear section.

Both internal sections of the hermetic shell 1 are themselves interconnected by an oil passage 20 in the shape of an axial hole arranged through the cylinder block 5. below the minimum lubricating oil level in both hermetic shell internal sections. There is also a gas duct 30 arranged through the cylinder block 5 and the flanges of the main bearing 10 and sub bearing 11 in a way to present an open end to the rear section of the hermetic shell 1 at a point above the maximum oil level in the rear section. The opposite end of gas duct 30 is open to the interior of the front section at a point above the normal operational level of the lubricating oil (LO) in the front section.

There is a level regulating passage 40 extending axially through the cylinder block 5 and the main bearing 10 and sub bearing 11 flanges and arranged in a way to define the maximum lubricating oil level in the front section volume during the compressor operation. The gas duct 30 outlet end is placed in the illustrated configuration. at a level slightly below the level of the regulating passage 40.

The gas duct 30 is dimensioned in a way to provide a pressure differential between the rear and the front sections of the hermetic shell. The pressure differential is enough to cause the lubricating oil level (LO) in the interior of the front section to be elevated until it reaches the front end of the horizontal shaft 7. It should be understood that the lower oil passage 20 has a suitable size to allow the free flow of the lubricating oil between the two sections of the shell without interfering in the pressure balance reached through the lubricating oil difference in levels in each one of the said sections.

Figure 2:
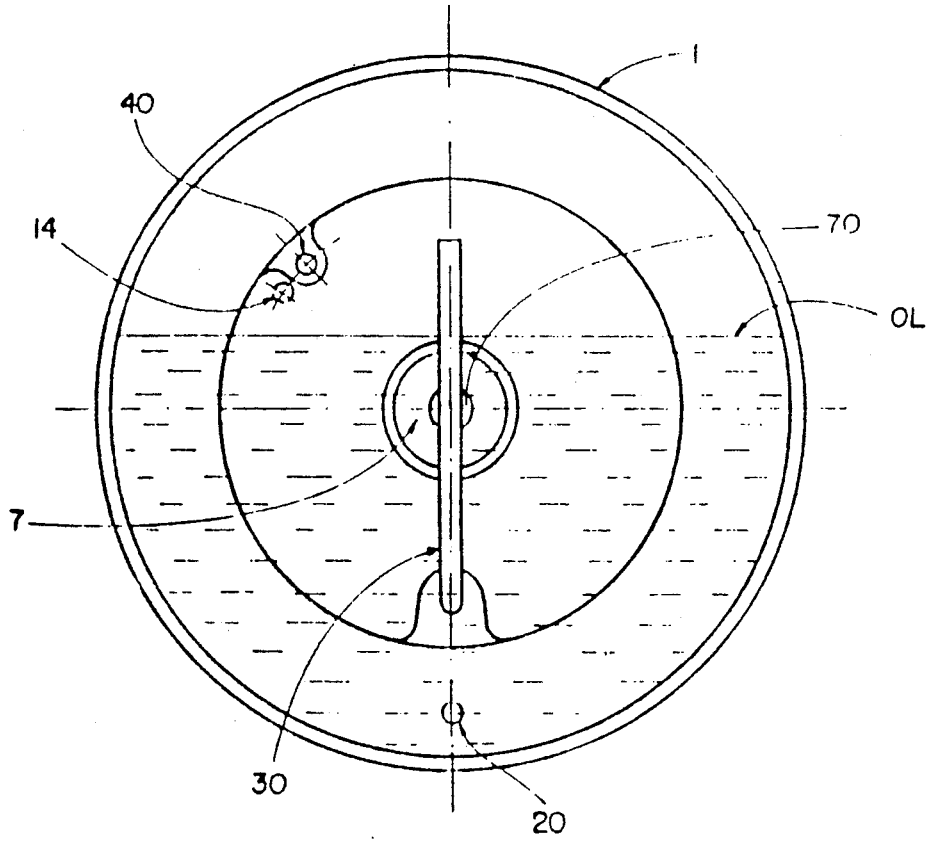
FIG. 2 shows an end view of the compressor of FIG. 1., with the shell extreme cover which carries the suction and discharge tubes removed.

According to what is illustrated in FIGS. 1 and 2, the front end portion of the horizontal shaft 7 is provided with a central hole 70. Radial channels interconnect the said axial hole 70 to the shaft 7 peripheral regions supported by the main bearing 10 and sub bearing 11. In FIG. 1, one of these radial channels 71 is illustrated.

With the arrangement described above, the pressure differential between the two internal sections of the hermetic shell causes the lubricating oil contained in the front section to reach the shaft 7 central axial hole, being then pushed toward the bearing support internal surface, assuring their lubrication.

The maximum operational level of the oil inside the front section is set by the level regulating passage 40 which is dimensioned in order to cause it to provide a suitable drainage of lubricating oil and/or gas from the front to the rear section without damaging the pressure differential. In the illustrated configuration, the regulating passage 40 is arranged adjacent to the gas discharge orifice 14 and open to the interior of the rear section in a common hole to the said gas discharge orifice 14 in a way to obtain from this orifice an ejecting effect regarding the level regulating passage 40.

In the illustrated construction, the level regulating passage 40 takes the shape of a duct arranged through the discharge muffler chamber 12.

While one way has been described and illustrated here of realizing the invention, it should be understood that changes can be made without digressing from the inventive concept defined in claim section.

What is claimed:

1. Lubricating system for a rotary horizontal crankshaft hermetic compressor comprising:

a hermetic shell provided with discharge and suction tubes and defining a lubricating oil sump at its bottom;

a compressor set in said shell including a cylinder block in whose interior a rolling piston rotates as an eccentric portion of a horizontal crankshaft, and an electric motor for rotating the crankshaft:

a main bearing and a sub bearing adjacent the cylinder block within which one end of the crankshaft is supported, the other end of the crankshaft mounted to the rotor of the electric motor, the crankshaft having at least one internal channel to provide oil lubrication to said main bearing within which it rotates;

the compressor set dividing the interior of the shell into a first section housing the electric motor and a second section, said discharge tube communicating with said second section;

means for providing gas flow communication of a discharge pressure between the second section and the first section;

an oil passage in the cylinder block below a minimum sump lubricating oil level to be produced in both sections;

a gas duct with one end communicating with the first section at a point above a maximum oil level to be provided in the first section and with the opposite end communicating with the second section at a point above a normal operational level of the lubricating oil in this section, said normal operational level of the lubricating oil in said second section being at a point above the level of the crankshaft and above said minimum oil level; and a level regulating passage through said cylinder block providing communication between said first and second sections to define the maximum lubricating oil level in the second section, said passage being dimensioned that the oil operational level in the second section elevated by a pressure differential between the two sections to reach at least the level of the crankshaft, which conveys the oil to the shaft internal channel to provide for bearing lubrication.

2. Lubricating system for rotary horizontal crankshaft hermetic compressor, according to claim 1 wherein the oil passage has the shape of an axial hole arranged through at least one of the compressor set cylinder block, main bearing and sub bearing.

3. Lubricating system for rotary horizontal crankshaft hermetic compressor according to claim 1 wherein the gas duct is arranged through at least one of the compressor set cylinder block, main bearing and sub bearing.

4. Lubricating system for rotary horizontal crankshaft hermetic compressor according to claim 1 wherein the gas duct opposite end is at a level below the level regulating passage.

5. Lubricating system for rotary horizontal crankshaft hermetic compressor according to claim 1 wherein the level regulating passage is arranged to convey to the first section the lubricating oil contained in the second section upon reaching the said passage.

6. Lubricating system for rotary horizontal crankshaft hermetic compressor according to claim 5 wherein the level regulating passage is defined through at least one of the compressor set cylinder block, main bearing and sub bearing.

7. Lubricating system for rotary horizontal crankshaft hermetic compressor, according to claim 1, wherein the level regulating passage is arranged adjacent to communicate with the gas of the gas discharge orifice.

8. Lubricating system for a horizontal crankshaft rotary compressor according to claim 1 wherein said means for providing gas flow communication comprises a muffler in said second section for receiving the discharged gas from the compressor cylinder, an orifice communicating with the compressor cylinder and rotating piston for receiving the compressor discharge and having a discharge orifice opening into said muffler, and a pressure passage through at least said cylinder block for conveying the discharge pressure from the muffler to said first section.

* * * * *

UNITED STATES PATENT AND TRADEMARK OFFICE

CERTIFICATE OF CORRECTION

PATENT NO. : 5,012,896

DATED : May 7, 1991

INVENTOR(S) : Caio M.F.N. Da Costa

It is certified that error appears in the above-identified patent and that said Letters Patent is hereby corrected as shown below:

On the title page of the patent, at Section [73], please delete "Empresa Brasileira de Compressores" and substitute therefor --Empresa Brasileira de Compressores S/A - EMBRACO--.

Signed and Sealed this

Twenty-third Day of August, 1994

*Attest:*

Bruce Lehman

BRUCE LEHMAN

*Attesting Officer*

*Commissioner of Patents and Trademarks*